US005165117A

United States Patent [19]

Kamata

[11] Patent Number: 5,165,117

[45] Date of Patent: Nov. 24, 1992

[54] SYSTEM FOR CONTROLLING THE OPENING AND CLOSING OF SHIELD PLATE OF A HELMET

[75] Inventor: Eitaro Kamata, Tokyo, Japan

[73] Assignee: Shoei Kako Kabushiki Kaisha, Tokyo, Japan

[21] Appl. No.: 704,484

[22] Filed: May 23, 1991

[30] Foreign Application Priority Data

Feb. 4, 1991 [JP] Japan ..... 3-013608

[51] Int. Cl.[5] ..... A42B 3/02

[52] U.S. Cl. ..... 2/424

[58] Field of Search ..... 2/424, 425, 5, 6, 10, 2/410, 9, 436

[56] References Cited

U.S. PATENT DOCUMENTS 4,581,775 4/1986 Nava ..... 2/424
4,748,696 6/1988 Fohl ..... 2/10
4,807,305 2/1989 Sundahl ..... 2/424
5,073,990 12/1991 Kamata ..... 2/424

*Primary Examiner*—Peter Nerbun
*Attorney, Agent, or Firm*—Armstrong & Kubovcik

[57] ABSTRACT

An elongated hole is provided in a shield plate to extend in a direction to open and close the shield plate, and a stopper pin is fixedly mounted on a cap body and adapted to be fitted into the elongated hole, so that the shield plate is restrained from opening more than a predetermined opening degree by abutment of the stopper pin against one end wall of the elongated hole. In addition, a cam member is mounted on the cap body for pushing up an end edge of the shield plate to permit the slipping of the stopper pin out of the elongated hole. These ensure that the shield plate can be restrained to a position corresponding to the predetermined opening degree, thereby preventing any clouding of an inner surface of the shield plate, while preventing the opening of the shield plate by a wind pressure.

4 Claims, 8 Drawing Sheets

SYSTEM FOR CONTROLLING THE OPENING AND CLOSING OF SHIELD PLATE OF A HELMET

BACKGROUND OF THE INVENTION

1. Field of the Invention

The field of the present invention is helmets suitable for an occupant on a racing car, a motorcycle or the like, and more particularly, systems for controlling the opening and closing of a shield plate of a helmet including a cap body having a window opening in a front surface thereof, and a shield plate pivotally mounted on the cap body to open and close the window opening.

2. Description of the Prior Art

In general, a click stop mechanism is provided at a pivotally mounted portion of the shield plate on the helmet for stepwisely adjusting and maintaining the opening degree of the shield plate (for example, see Japanese Utility Model Publication Kokoku No. 4897/83).

In use of the helmet, it is a normal practice to maintain the shield plate at a small opening degree, thereby slightly permitting airstream to be introduced inside the shield plate, in order to prevent an inner surface of the shield plate from being clouded up with an exhaled breath of a user. In this case, in the prior art helmet, the maintaining of the shield plate at the small opening degree relies upon the click stop mechanism, but there is a limit for the maintaining force of such mechanism. Therefore, the shield plate may be opened to an extent more than necessary by a pressure of airstream, depending upon the orientation of the cap body with respect to the airstream.

SUMMARY OF THE INVENTION

Accordingly, it is an object of the present invention to provide a system for controlling the opening and closing of a shield plate of a helmet, wherein the shield plate can be maintained at a predetermined small opening degree, so that it can be prevented from being unnecessarily opened by a wind pressure, and such maintained condition can be released as required.

To achieve the above object, in a first aspect of the present invention, there is provided a system for controlling the opening and closing of a shield plate of a helmet including a cap body having a window opening in a front surface thereof, and a shield plate pivotally mounted on the cap body to open and close the window opening, the system comprising a lock means provided between the cap body and the shield plate for restraining the shield plate from opening more than a predetermined small opening degree, and a lock releasing means provided on the cap body for releasing the operation of the lock means.

According to the first aspect of the present invention, the shield plate can be reliably maintained at the predetermined small opening degree, so that it can be prevented from being opened by an airstream in any orientations of the cap body. Therefore, it is possible to introduce an airstream in a small amount to eliminate the clouding of an inner surface of the shield plate, while exhibiting a windshield effect.

In addition to the first aspect, a second aspect of the present invention resides in that the lock means comprises an elongated hole formed in the shield plate to extend in opening and closing directions of the shield plate, and a stopper pin fixedly mounted on the cap body and adapted to be fitted into the elongated hole, so that the shield plate is restrained from opening more than the predetermined small opening degree by abutment of the stopper pin against one end wall of the elongated hole.

According to the second aspect of the present invention, the lock means can be constructed in an extremely simple structure and moreover, even if the lock means is in operation, the shield plate can be freely opened and closed within the predetermined small opening degree.

In addition to the second aspect, a third aspect of the present invention is in that the stopper pin has a slant formed at a tip end thereof for pushing up an end edge of the shield plate in the course of closing the shield plate from its widely opened position to permit the movement of the shield plate to its completely closed position.

According to the third aspect, the shield plate which is in the large opening degree position can be closed to the fully closed position without interference by the stopper pin, and the closing operation is easy.

In addition to either of the first to third aspect, a fourth aspect of the present invention is in that the lock releasing means comprises a cam member rotatably carried on the cap body, the cam member being provided with an arcuate surface for permitting the shield plate to be opened from the completely closed position to the small opening degree position by turning the cam member in a predetermined direction, and with a pushing-up surface for pushing up the shield plate at the small opening degree position to release the operation of the lock means.

According to the fourth aspect of the present invention, by the operation of the cam member, it is possible to provide a fine adjustment of the opening degree of the shield plate and a releasing of the operation of the lock means in a range of from the fully closed position to the predetermined small opening degree, and the operability is extremely good.

The above objects, features and advantages of the invention will become apparent from a reading of the following description of the preferred embodiment, taken in conjunction with the accompanying drawings.

BRIEF DESCRIPTION OF THE DRAWINGS

The drawings illustrate one embodiment of the present invention, wherein.

DESCRIPTION OF THE PREFERRED EMBODIMENT

The present invention will now be described by way of one embodiment in connection with the accompanying drawings.

Figure 1:
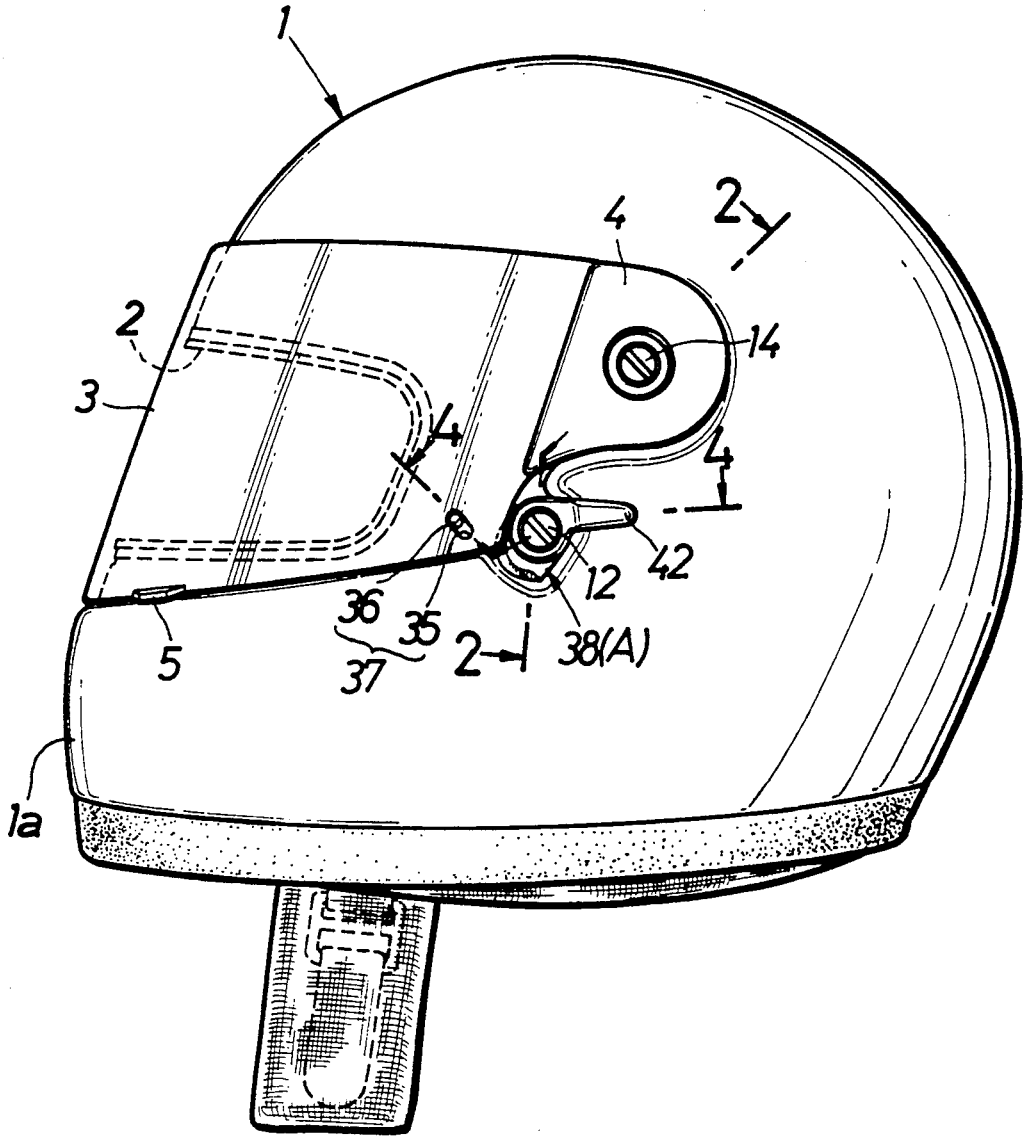
FIG. 1 is a side view of a helmet provided with a system for controlling the opening and closing of a shield plate.

Referring first to FIG. 1, a cap body 1 of a helmet is formed into a full-face type having a jaw covering portion 1*a* immediately below a window opening 2 in a front surface of the cap body 1. A transparent shield plate 3 made of synthetic resin for opening and closing the window opening 2 is attached to the cap body 1 through a pair of end covers 4 made of aluminum in a die-casting manner and covering opposite left and right ends of the shield plate 3. The shield plate 3 is U-shaped as viewed in a plane, with its left and right ends directed rearwardly, and has a knob 5 at a lower end edge thereof.

The mounting structure of end portions of the shield plate 3 will be described below in detail in connection with the FIGS. 2 to 5. The mounting structures of the left and right end portions of the shield plate 3 are similar to each other and hence, the mounting structure of the left portion will be typically described.

Figure 2:
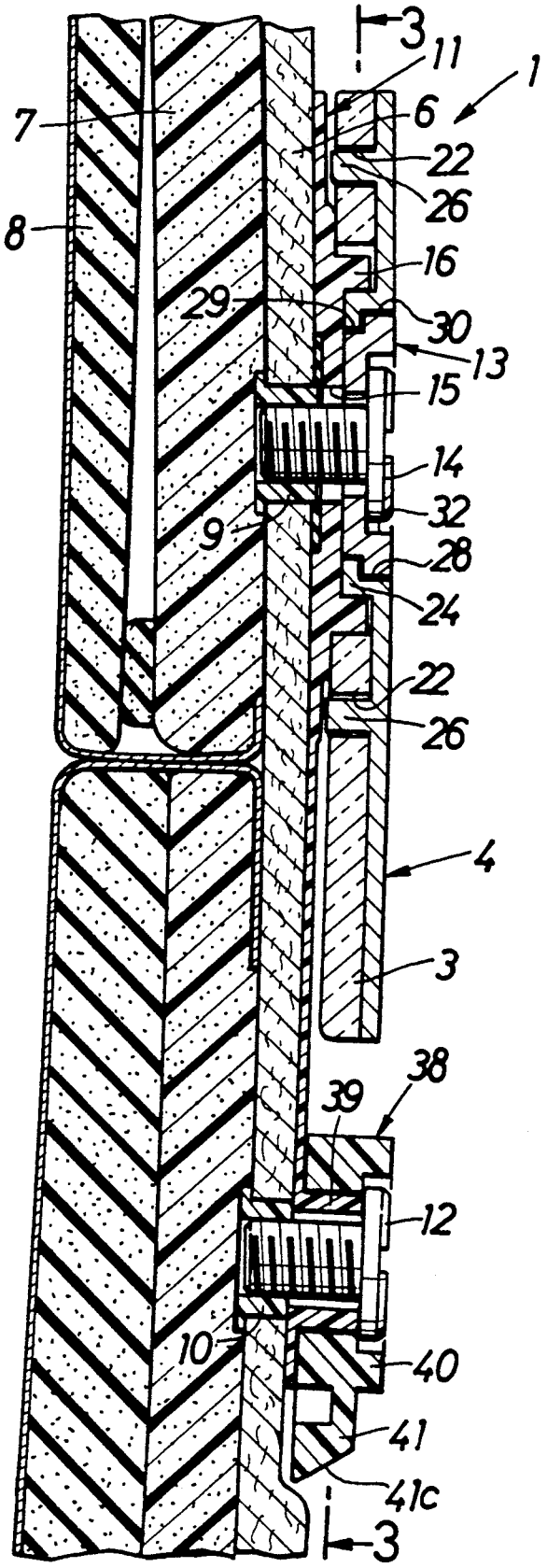
FIG. 2 is an enlarged sectional view taken along a line 2—2 in FIG. 1.

As shown in FIG. 2, the cap body 1 is comprised of a shell 6 made of fiber-reinforced resin, a buffer liner 7 made of foamed polystyrene and fitted into the shell 6, and a fit pad 8 made of urethane foam and mounted on an inner surface of the buffer liner 7. A pair of upper and lower nuts 9 and 10 are embedded in a sidewall of the shell 6.

A bracket plate 11 is fixed to an outer surface of the shell 6 by machine screws 12 and 14 screwed into the nuts 9 and 10.

The left end of the shield plate 3, the end cover 4 and a collar 13 are sequentially placed onto an outer surface of the bracket plate 11, and the machine screw 14 is screwed through the collar 13 into the upper nut 9 to fix the collar 13 together with the bracket plate 11 to the shell 6.

The bracket plate 11 has an annular projection wall 16 protruding from the outer surface thereof and concentric with a central hole 15 through which the machine screw 14 passes. An arcuate resilient piece 17 is integrally and concentrically connected at its opposite ends to an outer peripheral surface of the projection wall 16, and several click teeth 18 are integrally provided on an outer peripheral surface of the resilient piece 17. A stopper wall 19 is integrally connected to the projection wall 16 adjacent to an upper end of the resilient piece 17 but projecting more radially outwardly from the upper end. Further, recessed grooves 20 are provided in the outer surface of the bracket plate 11 inside the annular projection wall 16 to pass on a diametrical line of the projection wall 16.

The shield plate 3 is provided, at its end, with an arcuate recess 21 (see FIG. 3) rotatably engaging the outer peripheral surface of the annular projection wall 16, and further with a plurality of (three in the illustrated embodiment) connecting holes 22 located along a peripheral edge of the recess 21. The shield plate 3 is also formed at its end with a stopper portion 23 adapted to abut against the stopper wall 19 to define a fully-opened position of the shield plate 3.

The end cover 4 is integrally provided with a boss 24 protruding from an inner surface of the cover 4 and rotatably fitted over an inner peripheral surface of the annular projection wall 16, a surrounding wall 25 rising inwardly from a rear peripheral edge of the cover 4, and a plurality of connecting pins 26 protruding from the inner surface of the cover 4 and withdrawably fitted into the connecting holes 22.

Figure 3:
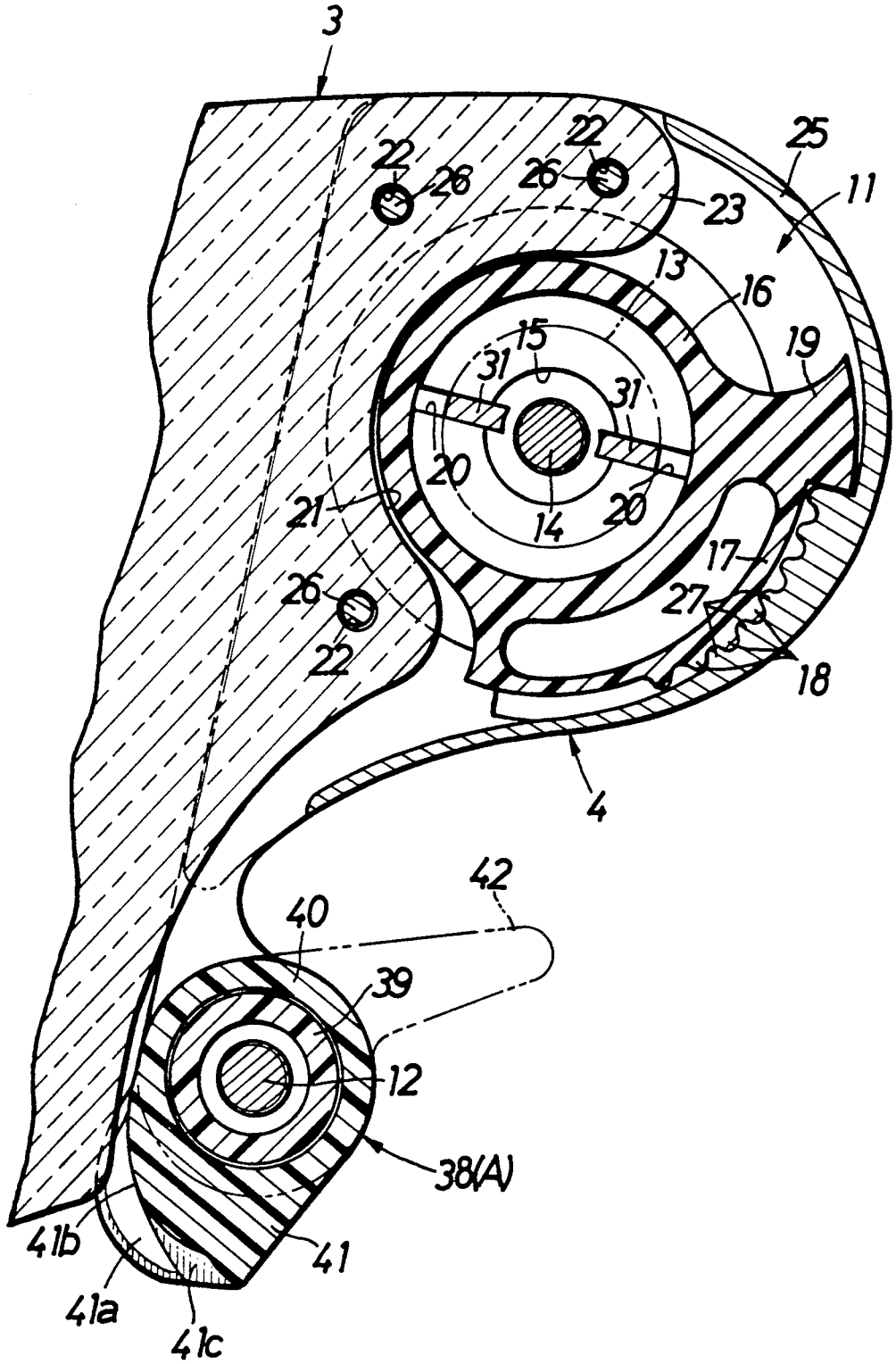
FIG. 3 is a sectional view taken along a line 3—3 in FIG. 2.
Figure 4:
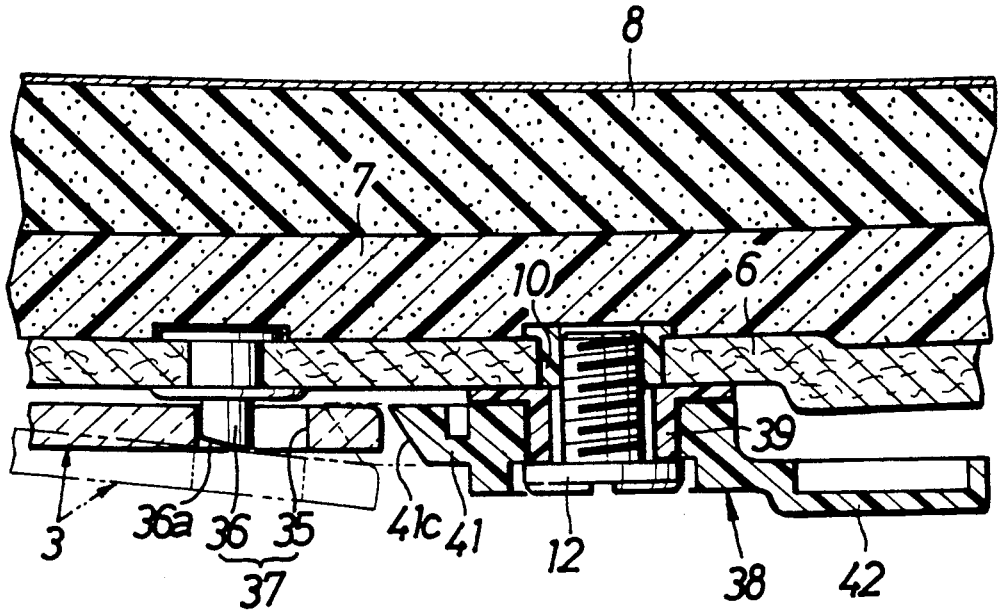
FIG. 4 is an enlarged sectional view taken along a line 4—4 in FIG. 1.
Figure 5:
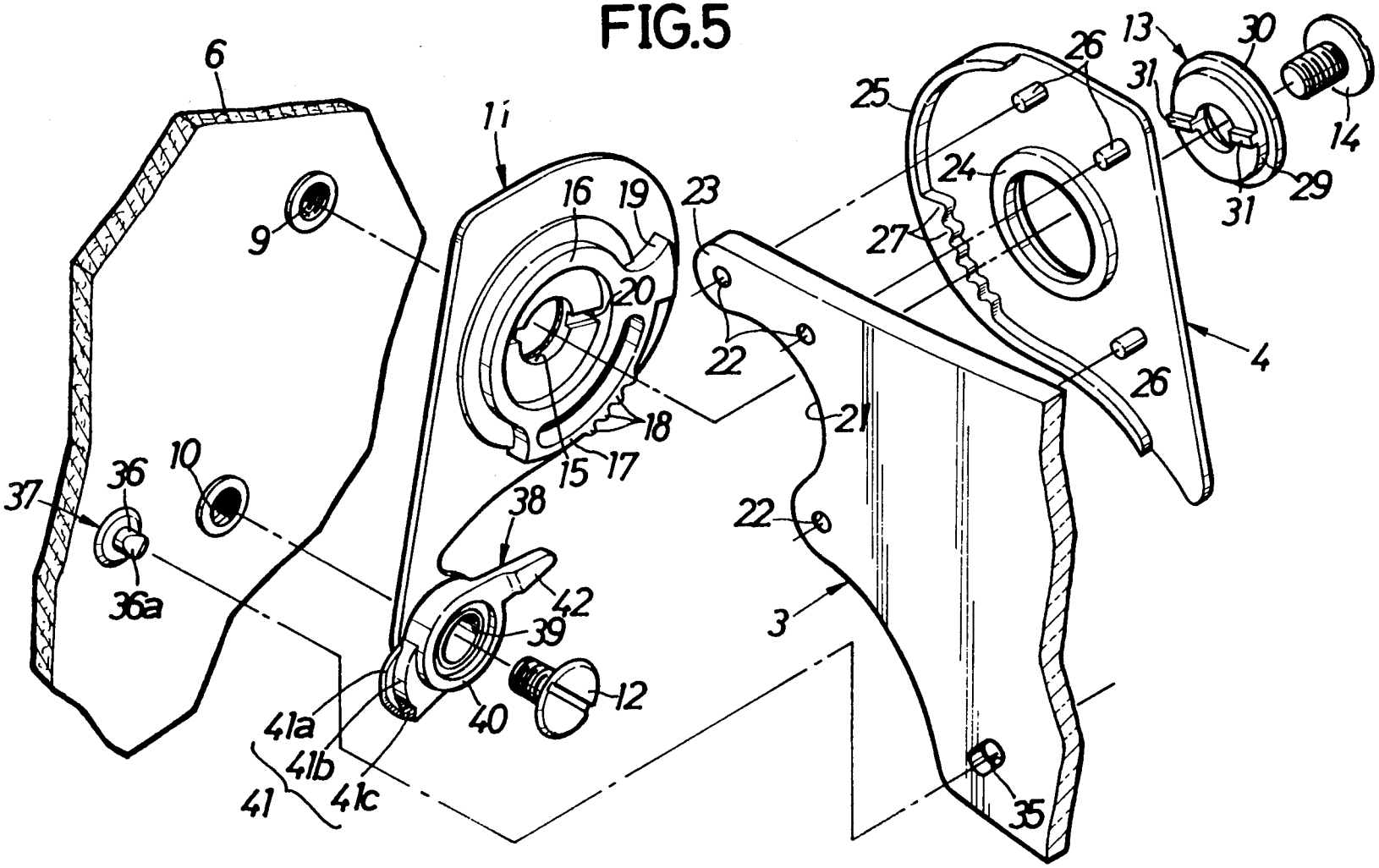
FIG. 5 is an exploded perspective view of the system for controlling the opening and closing of the shield plate.

A plurality of click teeth 27 are provided on an inner peripheral surface of the surrounding wall 25 to engage the click teeth 18 (see FIGS. 3 and 5).

An annular recess 28 is provided in an outer surface of the end cover 4 concentrically with the boss 24.

The collar 13 is comprised of a smaller diameter portion 29 rotatably fitted to an inner peripheral surface of the boss 24 and a larger diameter portion 30 rotatably fitted to an inner peripheral surface of the recess 28. The smaller diameter portion 29 includes projections 31 provided on an inner end face of the portion 29 to engage the recessed groove 20, and a recess 32 provided on an outer end face of the portion 29 to receive a head of the machine screw 14.

Thus, if a wearer of the helmet holds the knob 5 and vertically turns the shield plate 3 in order to open or close the window opening 2, the end cover 4 connected to the shield plate 3 through the connecting pin 26 is turned about the collar 13. The rotation of the end cover 4 causes the engagement positions of the click teeth 18 and 27 to be changed, while deforming the resilient piece 17, so that the shield plate 3 can be held at a desired turned position. During this time, the collar 13 cannot be rotated and hence, produces no looseness of the machine screw, because the projection 31 is in engagement in the recessed groove 20 of the bracket plate 11.

The larger diameter portion 30 is received in the recess 28 on the outer surface of the end cover 4, and the head of the machine screw 14 is received in the recess 32 on the outer surface of the collar 13. The outer surfaces of the three components 4, 13 and 14 are arranged on the substantially same plane and therefore, when airstream passes, any wind whistle cannot be produced.

Description will now be made of an opening-degree control system capable of opening and restraining the shield plate 3 in a smaller opening degree. Referring again to FIGS. 1 to 5, an elongated hole 35 is provided in a lefthand and lower portion of the shield plate 3 to extend in opening and closing directions of the shield plate 3, and a stopper pin 36 is mounted on the outer surface of the cap body 1 and adapted to be fitted into the elongated hole 35. The stopper pin 36 serves to restrain the movement of the shield plate 3 from its fully closed position to a predetermined small opening degree (e.g., an opening degree corresponding to a pitch between the adjacent clock teeth 18, or an opening degree slightly smaller than such pitch) by fitting in the elongated hole 35 and is adapted to be slipped out of the elongated hole 35 upon outward deflection of the end edge near the elongated hole of the shield plate 3. The stopper pin 36 has a slant 36*a* formed at its tip end and sloped down in the opening direction of the shield plate 3. A lock means 37 is constructed by the elongated hole 35 and the stopper pin 36.

On the other hand, on a left side of the cap body, a cam member 38 as a lock-releasing means is rotatably attached to the bracket plate 11 by utilizing the machine screw 12. More specifically, a tubular shaft 39 is integrally provided on the bracket plate 11 to surround the machine screw 12, and a boss 40 of the cam member 38 is rotatably fitted over the tubular shaft 39, such fitted state being maintained by a head of the screw 12.

The cam member 38 includes a cam 41 forwardly of the boss 40, and a lever 42 rearwardly of the boss 40. The cam 41 is adapted to be engaged with and disengaged from a lower edge of a left end of the shield plate 3 by the reciprocally turning movement of the lever 42.

The shape of the cam 41 will be described in detail in connection with the FIG. 3. The cam 41 comprises a guide portion 41*a* moving into between the cap body 1 and the shield plate 3, and an arcuate surface 41*b* rising from the guide portion 41*a*. The arcuate surface 41*b* is formed so that the distance from arcuate surface 41*b* to a center of the tubular shaft 39, i.e., to a turning center of the cam member 38 is gradually increased downwardly. In this arcuate surface 41*b*, an end spaced at shorter distance apart from the turning center of the cam member 38 is referred to as a starting end, and an end spaced at a longer distance apart from the turning center is to as a terminal end. A pushing-up surface 41*c* having an ascent gradient is formed to extend from a lower end of the guide portion 41*a* to the terminal end of the arcuate surface 41*b*.

Figure 6:
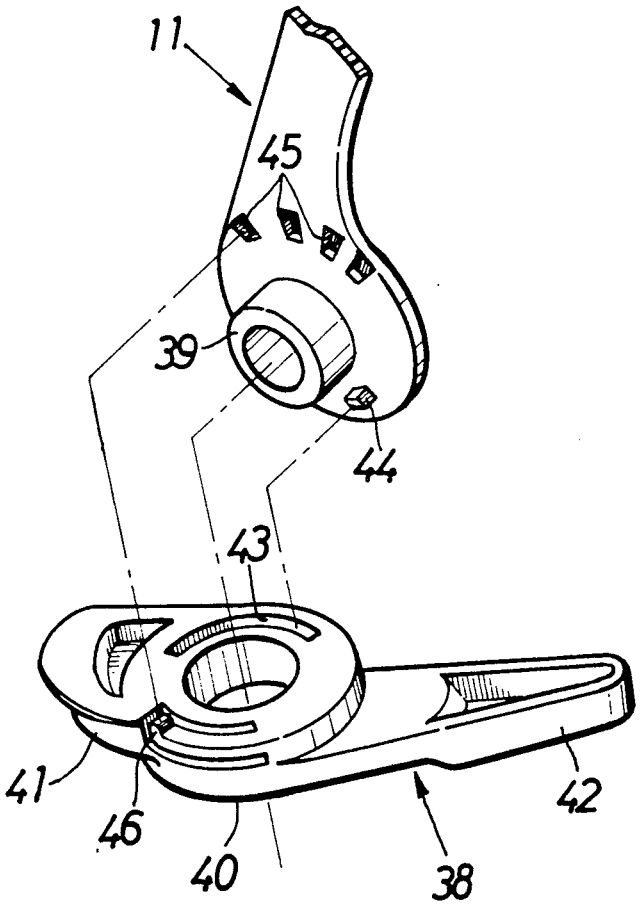
FIG. 6 is a further exploded perspective view of an essential portion shown in FIG. 5.

As shown in FIG. 6, a guide groove 43 arcuate about the turning center of the cam member 38 is formed in one of opposed surfaces of the bracket plate 11 and the cam member 38, and a stopper 44 is formed on the other for engagement in the guide groove 43. An inoperative position A and an operative limit position B of the cam member 38 are defined by abutment of the stopper 44 against one end wall and the other end wall of the guide groove 43, respectively.

Four notches 45 are provided in one of the opposed surfaces of the bracket plate 11 and the cam member 38 at equal distances on an arc of circle having a center provided by the rotational center of the cam member 38, and a click tooth 46 is formed on the other and adapted to relisiently engage the notches 45 sequentially upon turning movement of the cam member 38 from the inoperative position A to the operative limit position B.

Figure 7:
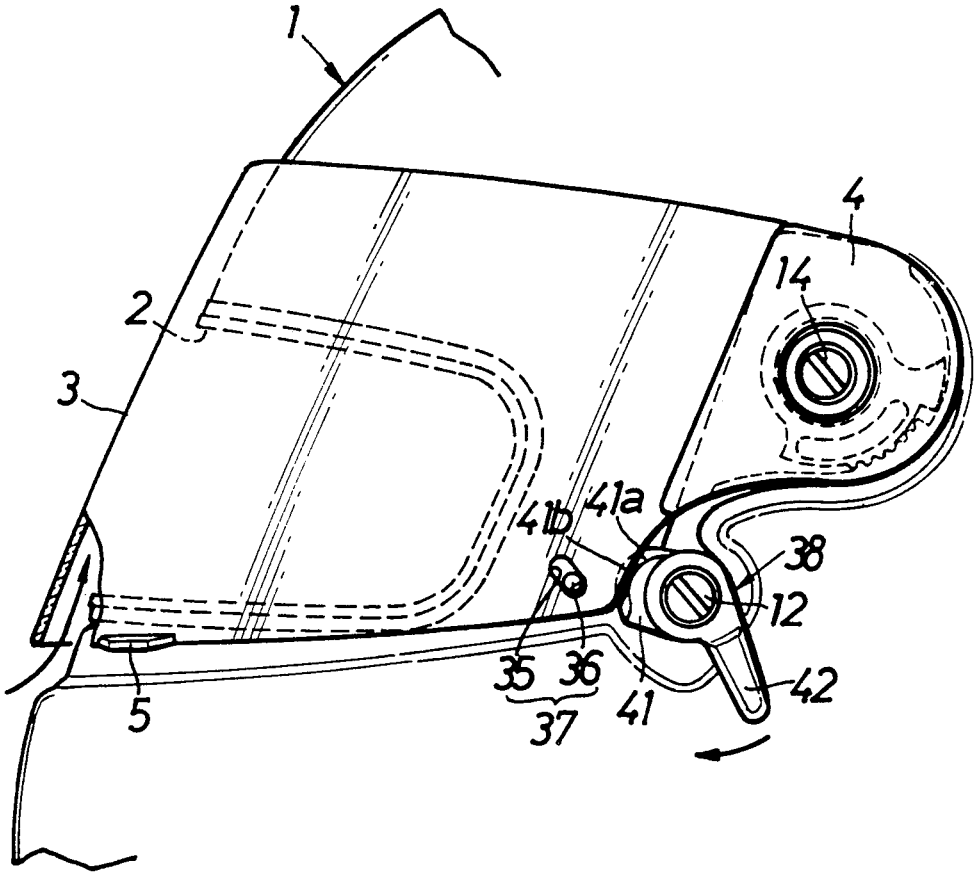
FIG. 7 is a view illustrating the shield plate opened at a predetermined small opening degree for explaining the operation.
Figure 8:
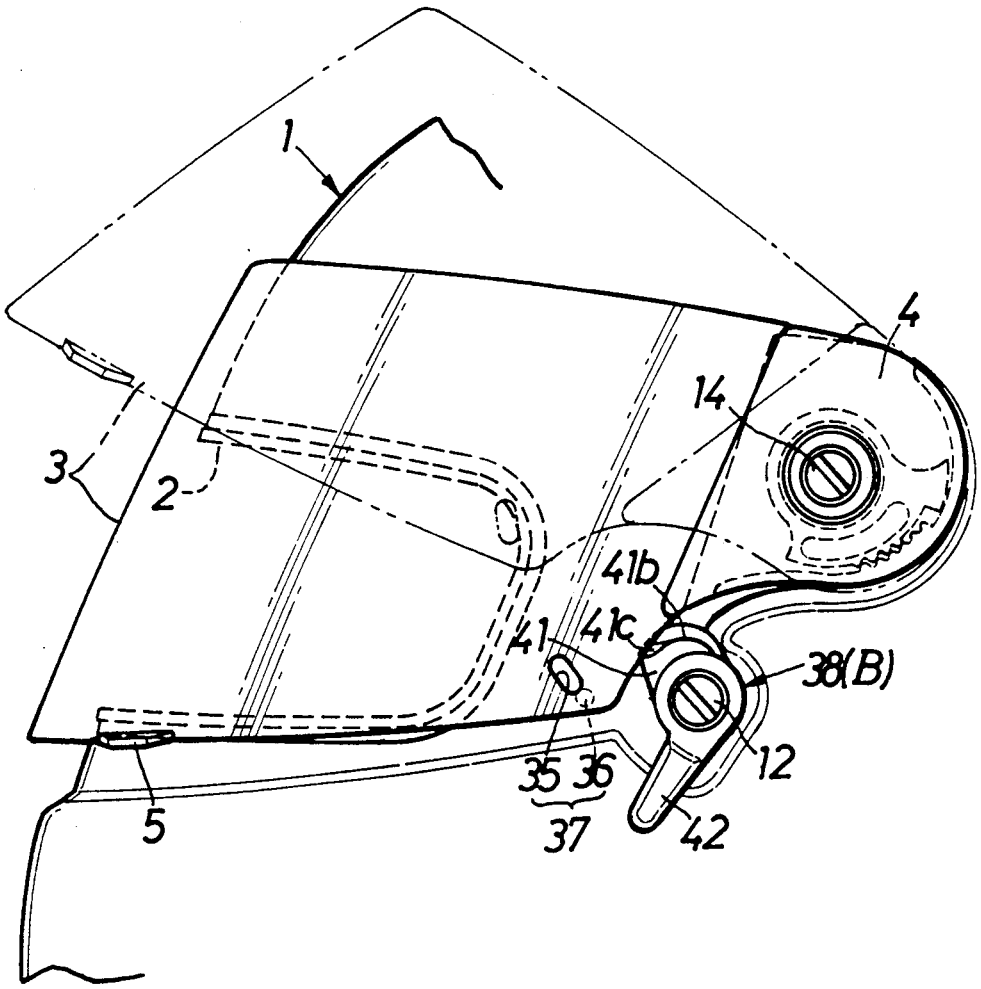
FIG. 8 is a view illustrating the shield plate with the operation of a lock means being released.

As shown in FIGS. 1 to 3, when the shield plate 3 is in its fully closed position, the stopper pin 36 assumes a position near the upper end wall of the elongated hole 35 in the shield plate 3. If the cam member 38 is turned from the inoperative position A toward the operative position B by the lever 42, the arcuate surface 41*b* urges down the lower edge of the shield plate 3, thereby ensuring that the shield plate 3 can be gradually opened to the predetermined small opening degree position in which the lower end wall of the elongated hole 35 abuts against the stopper pin 36 (see FIG. 7).

In this state of the small opening degree, the shield plate 3 is locked by abutment of the elongated hole 35 with the stopper pin 36 and hence, the shield plate 3 cannot be opened inadvertently even if it is subjected to a strong opening force provided by the airstream.

To open the shield plate 3 to an extent more than the small opening degree, the cam member 38 may be turned to the operative limit position B by the lever 42. Then, the pushing-up surface 41*c* pushes up the end edge of the shield plate 3 from the back side to deflect the shield plate 3 outwardly, thereby permitting the stopper pin 36 to be slipped out of the elongated hole 35.

Thereafter, the shield plate 3 can be opened to the fully opened position by holding the knob 5 in the conventionally normal manner to apply applying an upwardly turning force to the shield plate 3.

To fully close the shield plate 3 from the fully opened position, the cam member 38 may be first returned to the inoperative position A and then, the knob 5 may be held to lower the shield plate 3. Even if the lower end edge of the shield plate 3 abuts against the slant 36*a* at the tip end of the stopper pin 36 with lowering movement of the shield plate 3, the latter can continue the lowering movement while being deflected outwardly in such a manner that it climbs over the slant 36*a*, until it reaches the fully closed position. If the elongated hole 35 of the shield plate 3 reaches a position corresponding to the stopper pin 36 during this period of time, it is fitted with the stopper pin 36 by a restoring force of the shield plate 3.

What is claimed is:

1. A system for controlling the opening and closing of a shield plate of a helmet including a cap body having a window opening in a front surface thereof, and a shield plate pivotally mounted on the cap body to open and close said window opening, said system comprising:

an elongated hole formed in said shield plate to extend in opening and closing directions of said shield plate;

a stopper pin fixedly mounted on said cap body and adapted to be received in said elongated hole, so that said shield plate is restrained from opening more than a predetermined small opening degree by abutment of said stopper pin against one end wall of said elongated hole; said stopper pin having a slant formed at a tip end thereof for pushing up an end edge of said shield plate in the course of closing said shield plate from an opening position of more than the predetermined small opening degree so as to permit the movement of said shield plate to its completely closed position; and a lock releasing means provided on said cap body for releasing engagement of said stopper pin with said elongated hole.

2. A system for controlling the opening and closing of a shield plate of a helmet including a cap body having a window opening in a front surface thereof, and a shield plate pivotally mounted on the cap body to open and close said window opening, said system comprising;

a lock means provided between said cap body and said shield plate for restraining said shield plate from opening more than a predetermined small opening degree; and a lock release means provided on said cap body for releasing the operation of said lock means, said lock releasing means including a cam member rotatably carried on said cap body, said cam member being provided with an arcuate surface for permitting said shield plate to be opened from the completely closed position to a position of the predetermined small opening degree by turning said cam member in a predetermined direction, and with a pushing-up surface for pushing up said shield plate at the position of said predetermined small opening degree to release the operation of said lock means.

3. A system for controlling the opening and closing of a shield plate of a helmet including a cap body having a window opening in a front surface thereof, and a shield plate pivotally mounted on the cap body to open and close said window opening, said system comprising:

an elongated hole formed in said shield plate to extend in opening and closing directions of said shield plate;

a stopper pin fixedly mounted on said cap body and being adapted to be received in said elongated hole, so that said shield plate is restrained from opening more than a predetermined small opening degree by abutment of said stopper pin against one end wall of said elongated hole; and a lock releasing means provided on said cap body for releasing engagement of said stopper pin with said elongated hole, said lock releasing means including a cam member rotatably carried on said cap body, said cam member being provided with an arcuate surface for permitting said shield plate to be opened from the completely closed position to a position of the predetermined small opening degree by turning said cam member in a predetermined direction, and with a pushing-up surface for pushing up said shield plate at the position of said predetermined small opening degree to release the engagement of said stopper pin with said elongated hole.

4. A system for controlling the opening and closing of a shield plate of a helmet including a cap body having a window opening in a front surface thereof, and a shield plate pivotally mounted on the cap body to open and close said window opening, said system comprising:

an elongated hole formed in said shield plate to extend in opening and closing directions of said shield plate; and a stopper pin fixedly mounted on said cap body and adapted to be received in said elongated hole, so that said shield plate is restrained from opening more than a predetermined small opening degree by abutment of said stopper pin against one end wall of said elongated hole, said stopper pin having a slant formed at a tip end thereof for pushing up an end edge of said shield plate in the course of closing said shield plate from an opening position of more than the predetermined small opening degree so as to permit the movement of said shield plate to its completely closed position; and a lock releasing means provided on said cap body for releasing engagement of said stopper pin with said elongated hole, said lock release means including a cam member rotatably carried on said cap body, said cam member being provided with an arcuate surface for permitting said shield plate to be opened from the completely closed position to a position of predetermined small opening degree by turning said cam member in a predetermined direction, and with a push-up surface for pushing up said shield plate at the position of said predetermined small opening degree to release the engagement of said stopper pin with said elongated hole.

* * * * *